US012577710B2

(12) United States Patent
Ellerhorst et al.

(10) Patent No.: US 12,577,710 B2
(45) Date of Patent: Mar. 17, 2026

(54) STITCH-PRESSING COMPONENT, KNITTING MACHINE WITH STITCH-PRESSING COMPONENT, AND METHODS OF MANUFACTURING, INTEGRATING, AND USING THE SAME

(71) Applicant: NIKE, Inc., Beaverton, OR (US)

(72) Inventors: Martin Ellerhorst, Beaverton, OR (US); Daren P. Tatler, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/643,754

(22) Filed: Apr. 23, 2024

(65) Prior Publication Data

US 2024/0360602 A1 Oct. 31, 2024

Related U.S. Application Data

(60) Provisional application No. 63/498,212, filed on Apr. 25, 2023.

(51) Int. Cl.
*D04B 15/90* (2006.01)
*D04B 7/04* (2006.01)

(52) U.S. Cl.
CPC ..... *D04B 15/90* (2013.01); *D04B 7/04* (2013.01)

(58) Field of Classification Search
CPC ..... D04B 15/54; D04B 15/56; D04B 15/90; D04B 7/14
USPC ..... 66/109, 64, 90
See application file for complete search history.

(56) References Cited

U.S. PATENT DOCUMENTS 3,685,317 A * 8/1972 Giachetti ..... D04B 15/90 66/64
4,027,504 A * 6/1977 Dietschy ..... D04B 15/90 66/64
RE29,861 E * 12/1978 Dietschy ..... D04B 15/90 66/64
4,442,683 A * 4/1984 Shima ..... D04B 15/90 66/64

(Continued)

FOREIGN PATENT DOCUMENTS

EP 3034665 A1 6/2016
JP 2009-191416 A 8/2009

OTHER PUBLICATIONS

International Search Report and Written Opinion received for PCT Patent Application No. PCT/US2024/026167, mailed on Jul. 26, 2024, 15 pages.

*Primary Examiner* — Danny Worrell
(74) *Attorney, Agent, or Firm* — Shook, Hardy & Bacon L.L.P.

(57) ABSTRACT

Stitch-pressing components, knitting machines with stitch-pressing components, and methods of manufacturing, integrating, and using the same. The stitch-pressing components herein can be configured to replace a yarn-feeder that is mounted on a rail of a knitting machine. This allows the stitch-pressing component to be shifted along the rail, and shifted between a raised position and a lowered position like the yarn-feeder, so that the stitch-pressing component can be used to press on yarn that is inlaid to form part of a knitted structure. The stitch-pressing components herein can be implemented in knitting machines to facilitate different stitch-pressing processes with limited cost, complexity, and modification to existing knitting machines.

22 Claims, 7 Drawing Sheets

(56) References Cited

U.S. PATENT DOCUMENTS

| | | | | | |
|---|---|---|---|---|---|
| 5,060,488 | A * | 10/1991 | Stoppazzini | D04B 15/90 | 66/90 |
| 5,063,755 | A * | 11/1991 | Shima | D04B 15/90 | 66/90 |
| 5,280,712 | A * | 1/1994 | Nakamori | D04B 15/06 | 66/106 |
| 5,408,849 | A * | 4/1995 | Schimko | D04B 15/06 | 66/106 |
| 5,415,016 | A * | 5/1995 | Hirai | D04B 15/90 | 66/90 |
| 7,059,157 | B2 * | 6/2006 | Morita | D04B 15/90 | 66/90 |
| 7,272,959 | B2 | 9/2007 | Morita et al. | | |
| 9,404,206 | B2 * | 8/2016 | Meir | D04B 15/90 | |
| 2004/0221621 | A1 * | 11/2004 | Miyai | D04B 7/04 | 66/95 |
| 2014/0238082 | A1 | 8/2014 | Meir | | |
| 2024/0360602 | A1 * | 10/2024 | Ellerhorst | D04B 15/90 | |

* cited by examiner

STITCH-PRESSING COMPONENT, KNITTING MACHINE WITH STITCH-PRESSING COMPONENT, AND METHODS OF MANUFACTURING, INTEGRATING, AND USING THE SAME

CROSS-REFERENCE TO RELATED APPLICATIONS AND PRIORITY CLAIM

This non-provisional patent application claims priority to co-pending U.S. provisional patent app. No. 63/498,212, filed on Apr. 25, 2023, and titled "STITCH-PRESSING COMPONENT, KNITTING MACHINE WITH STITCH-PRESSING COMPONENT, AND METHODS OF MANUFACTURING, INTEGRATING, AND USING THE SAME," the entire contents of which is incorporated by reference herein.

TECHNICAL FIELD

The field relates to knitting machines and methods of forming knitted structures using knitting machines.

BACKGROUND

Knitting machines are often used to form knitted structures. For example, automated knitting machines that include a plurality of yarn-feeders, a carriage, and a needle bed are often used to form knitted structures quickly and repeatedly as part of automated textile manufacturing. Knitting machines can sometimes include a single needle bed, or can include a pair of adjacent needle beds so that stitches formed on the knitting machine are shifted between the needle beds. In some knitting processes, yarns, cables, and/or strands of a larger diameter are introduced by a knitting machine into a knitted structure that is otherwise primarily formed from yarns of a smaller diameter. The introduction of such larger structures can create issues with the operation of a knitting machine, e.g., interference with machine components or imprecise control of the larger structure, among other things.

SUMMARY

This summary is intended to introduce a selection of concepts in a simplified form, which are further described below in the detailed description section of this disclosure. This summary is not intended to identify key or essential features of the claimed subject matter, nor is it intended to be used as an aid in isolation to determine the scope of the claimed subject matter.

In brief, and at a high level, this disclosure describes, among other things, stitch-pressing components, knitting machines with stitch-pressing components, and methods of manufacturing, integrating, and using the same, among other things. The stitch-pressing components described herein are configured to be integrated into a knitting machine in place of a yarn-feeder so that the stitch-pressing components can be used to impart pressure on parts of a knitted structure (e.g., inlaid yarns, strands, and/or cables) formed by the knitting machine, do so with limited interference to other operational components of the knitting machine, and also do so with limited cost, complexity, and required modification to the knitting machine itself, among other benefits.

In aspects, a stitch-pressing component is provided. The stitch-pressing component can include an elongated body. The elongated body can include a first end coupled to an attachment structure that is configured to attach to part of a knitting machine, and the elongated body can include a second end that has a pressing tip. The pressing tip is shaped and oriented so that it can be used to impart pressure on part of a knitted structure formed by the knitting machine. In aspects, the pressing tip can be configured for pressing in one direction, or in two directions, e.g., in opposite directions, on a knitting machine. In one example, the stitch-pressing component can be used to push or press on a larger diameter yarn, strand, or cable that is inlaid by an associated knitting machine as part of a knitted structure, thereby allowing a remaining portion of the knitted structure to be formed over, around, and/or adjacent to the inlaid component with less interference between the inlaid component and other elements of the knitting machine, e.g., needles used to form stitches.

In aspects, a knitting machine and related assembly are provided. The knitting machine includes an integrated stitch-pressing component that is operable to press, push on, or shift parts of a knitted structure being formed on the knitting machine. In aspects, the knitting machine includes a pair of needle beds separated by a gap, a plurality of yarn-feeders, a plurality of rails that support and allow for translation of the plurality of yarn-feeders, and a carriage. The yarn-feeders can be translated/shifted linearly along the rails by the carriage and in doing so deposit yarns onto the pair of needle beds where needles can be operated, e.g., closed and opened, to form a knitted structure. The stitch-pressing component is configured so that it can be coupled to one of the plurality of rails in place of one of the plurality of yarn-feeders, e.g., in an interchangeable fashion. This allows the stitch-pressing component to be shifted to different positions along a length of the rail, similar to a yarn-feeder. In addition, the stitch-pressing component can be actuated from a raised position to a lowered position so that it can press on part of a knitted structure, e.g., an inlaid yarn, strand, or cable that is positioned in the gap between the needle beds by another yarn-feeder operating ahead of the stitch-pressing component.

In aspects, a method of modifying a knitting machine for stitch-pressing and a method of performing stitch-pressing on a knitting machine are provided. In one aspect, the knitting machine includes a pair of needle beds separated by a gap, a plurality of yarn-feeders, a plurality of rails that support and allow for translation of the plurality of yarn-feeders, and a carriage. The method can include de-coupling a yarn-feeder or an extension thereof from a rail of the knitting machine, and then coupling a stitch-pressing component or extension thereof to the rail of the knitting machine in place of the yarn-feeder or extension thereof. The method can include translating a yarn-feeder of the plurality of yarn-feeders while it deposits a yarn, strand, or cable onto the needle beds of the knitting machine (or along a gap therebetween), and in addition, shifting the stitch-pressing component (while in a lowered position) along its corresponding rail to press on the yarn, strand, or cable inlaid by the first yarn-feeder. This pressing operation can result in the inlaid yarn, strand, or cable being pressed into the gap between the needle beds, e.g., limiting the inlaid yarn, strand, or cable's interaction/impact with needles of the needle beds and allowing a knitted structure to be formed over, around, or adjacent to the inlaid yarn, strand, or cable. The method can further include shifting additional yarn-feeders to deposit yarns (e.g., of a smaller diameter than the inlaid yarn, strand, or cable) while operating needles of the needle beds to thereby form a knitted structure over, around, or adjacent to the inlaid component pressed into the gap by the stitch-pressing component.

The stitch-pressing components, knitting machines with stitch-pressing components, and methods of manufacturing, integrating, and using the same described herein provide multiple advantages, efficiencies, and capabilities. For example, using the stitch-pressing components and related assemblies described herein, parts of a knitted structure formed by a knitting machine can be more effectively pressed, pushed, biased, and/or maintained in a desired position during a knitting process. This can in addition be accomplished without requiring a more dedicated, complex, and/or costly component, assembly, and/or retrofit for a knitting machine otherwise not configured for particular types of stitch-pressing. It can also allow the configuration and functionality of a knitting machine to be adapted, updated, and/or changed with greater efficiency. It can also allow knitted structures to be formed faster by a knitting machine, e.g., with reduced stop-time and with reduced potential for interference between components. This helps streamline manufacturing and supports more sustainable manufacturing practices, among other benefits.

BRIEF DESCRIPTION OF THE DRAWINGS

The stitch-pressing components, knitting machines with stitch-pressing components, and methods of manufacturing, integrating, and using the same described herein are discussed in detail in connection with the attached figures, which are intended to illustrate non-limiting examples, in which.

DETAILED DESCRIPTION

Figure 1:
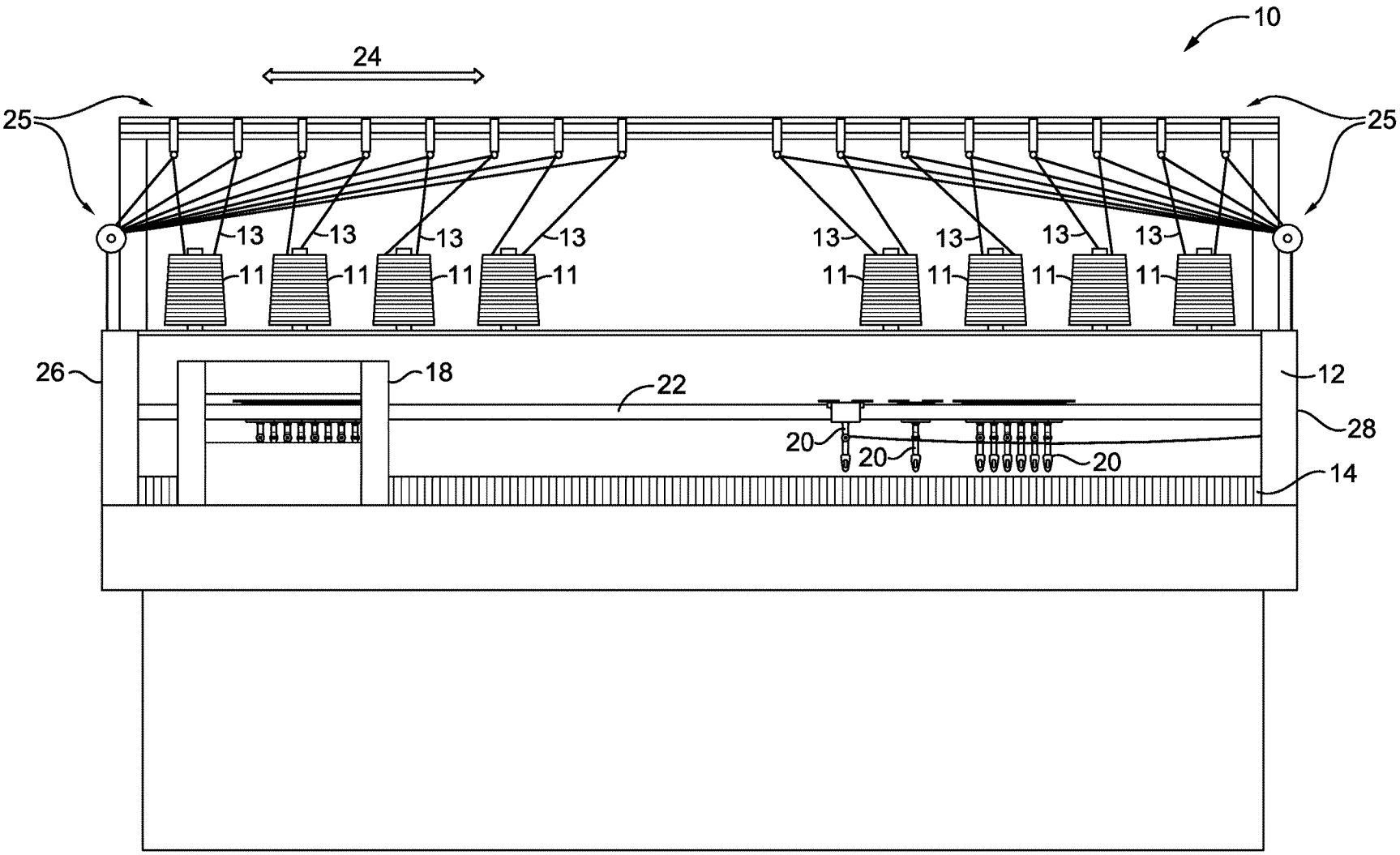
FIG. 1 depicts a knitting machine, in accordance with aspects hereof.

This detailed description is provided in order to meet statutory requirements. However, this description is not intended to limit the scope of the disclosure herein. Rather, the claimed subject matter may be embodied in different ways, to include different steps, different combinations of steps, different elements, and/or different combinations of elements, similar to those described in this disclosure, and in conjunction with other present or future technologies. In addition, although the terms "step" and "block" may be used herein to identify different elements of methods employed, the terms should not be interpreted as implying any particular order among or between different elements except when the order is explicitly stated.

In general, aspects herein relate to stitch-pressing components, knitting machines with stitch-pressing components, and methods of manufacturing, integrating, and using the same during knitting processes, among other things.

The stitch-pressing components described herein can be integrated into different knitting machines, including automated knitting machines, and can be used to press, push, bias, and/or hold (e.g., at a fixed location and/or transitionally along multiple locations) parts of a knitted structure or component formed by a knitting machine during a knitting process. Use of the stitch-pressing components described herein can limit undesired interference, e.g., between parts of a knitted structure and components of a knitting machine, and can also allow certain types of knitted structures to be formed on a knitting machine more efficiently, effectively, and precisely. In addition, the aspects described herein can be implemented with limited modification to existing knitting machines, assemblies, and components, and with limited reduction in operability of adjacent components of a knitting machine. This helps limit the cost of implementation, retrofit, reconfiguration, maintenance, and repair of associated knitting machines. It also helps limit stop-time and/or operation at reduced speed during a knitting process. This can increase the efficiency of producing knitted products, and in turn, help improve the sustainability of related manufacturing processes. Example aspects that accomplish these benefits are discussed below in connection with attached FIGS. 1-12.

Knitting can be performed by hand. However, the commercial manufacture of knitted components and related structures, textiles, apparel, and footwear is often performed by knitting machines that are at least partially automated (e.g., can perform knitting operations without requiring continuous operator control/input). Knitting machines can include a single needle bed, or can include multiple needle beds, and can include yarn-feeders that are shifted to supply yarn onto the needle beds where needles are subsequently operated to form the yarn into a knitted structure. It should be understood that while numerous aspects herein are discussed in the context of one type of knitting machine, e.g., a knitting machine with two needle beds such as a V-bed knitting machine, the aspects described herein are applicable to many different types of knitting machines in addition to those depicted and described herein.

Figure 2:
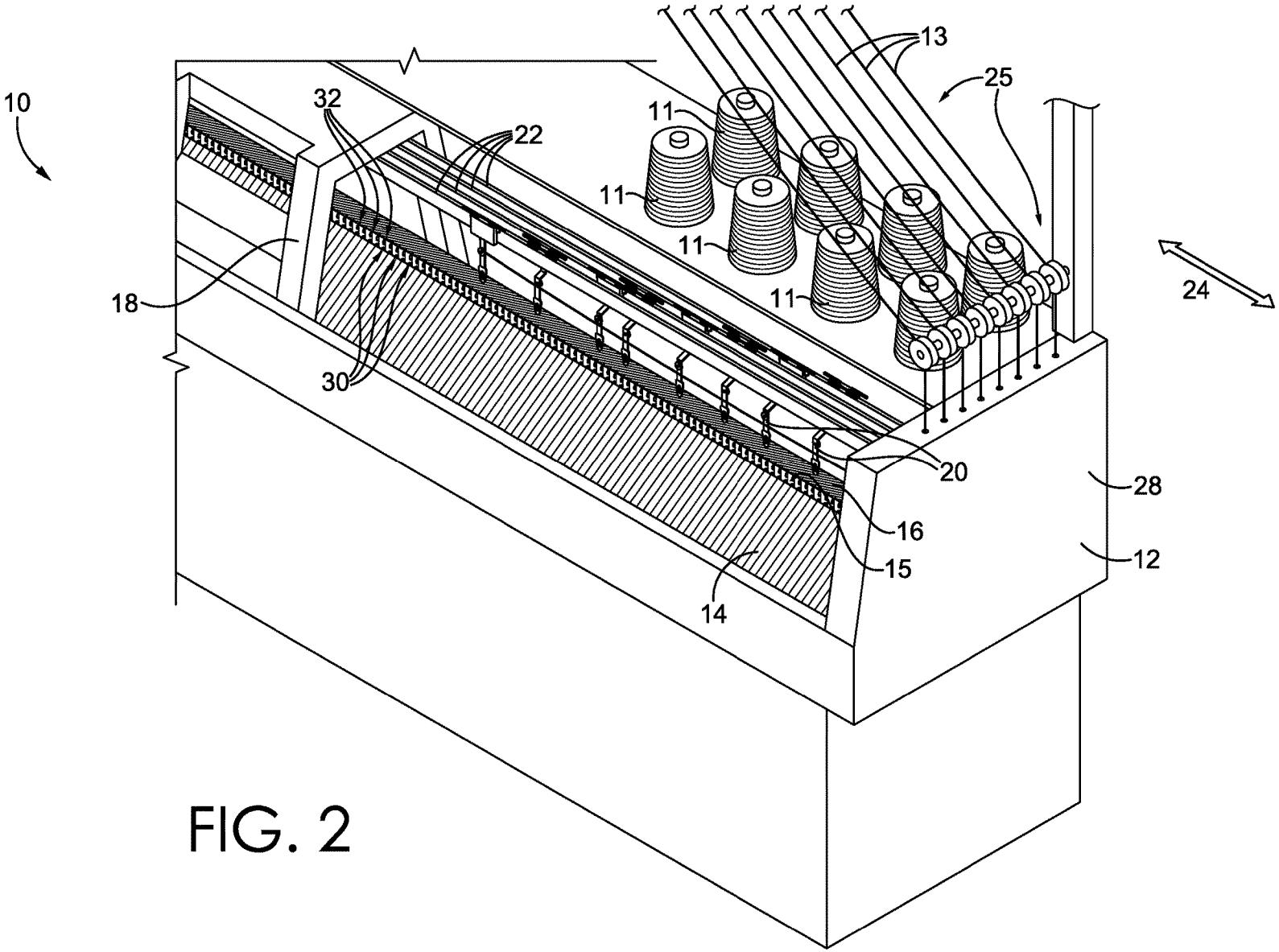
FIG. 2 depicts a partial, enhanced, and perspective view of the knitting machine shown in FIG. 1, in accordance with aspects hereof.

Looking at FIGS. 1 and 2, a knitting machine 10 is shown, in accordance with aspects hereof. FIG. 2 depicts an enhanced, partial, and perspective view of part of the knitting machine 10 shown in FIG. 1. The knitting machine 10 includes an assembly of components that are operable in coordination, and in at least partially automated fashion, to form a knitted structure. In aspects, the knitting machine 10 can be configured to form different types of knitted structures, e.g., knitted structures for apparel (e.g., clothing), knitted structures for footwear (e.g., shoe uppers), and/or knitted structures integrated into other consumer products, among other things.

The knitting machine 10 includes a support structure 12. The support structure 12 provides support for a pair of adjacent needle beds 14, 16 on the knitting machine 10. The needle beds 14, 16 are separated by a needle bed gap 15 as shown most clearly in FIG. 2. The knitting machine 10 also includes a carriage 18 and a plurality of yarn-feeders 20 that are supported by a plurality of rails 22. The yarn-feeders 20 are slidable to different positions on their corresponding rails 22 through operation of the carriage 18. The knitting machine 10 includes a plurality of reels/spools 11 that each feed a corresponding yarn 13 to a corresponding one of the yarn-feeders 20. During operation of the knitting machine 10, the yarn-feeders 20 can feed the yarns 13 onto the needle beds 14, 16 as the yarn-feeders 20 are shifted along their corresponding rails 22 through operation of the carriage 18.

The term "yarn," as used herein, is intended to be broadly encompassing. The yarns referred to herein can be any elongated element that can be used to form part or all of a knitted structure. The yarns referred to herein can be formed from one or more threads, fibers, filaments, mono-filaments, cables, strands, chains, cords, ropes, wires, or other elongated components (natural, synthetic, or manufactured). The yarns referred to herein can be formed from single components (e.g., a single thread) or can be formed from multiple components (e.g., multiple threads). The latter can be provided for example through the components being wound, braided, bonded, adhered, or otherwise joined or combined to form a single yarn. The yarns referred to herein can also have different cross-sectional shapes, e.g., round, triangular, square, rectangular, hexagonal, or other cross-sectional shapes.

FIGS. 1 and 2 show the knitting machine 10 with a particular number of yarn-feeders 20 and corresponding rails 22 for example purposes. However, in other aspects, the knitting machine 10 can have a different number of yarn-feeders 20, corresponding rails 22, and corresponding number of spools/yarns 11, 13 available for a knitting process. In an aspect, the knitting machine 10 can include 8 yarn-feeders and corresponding rails, and thus can manipulate up to 8 different yarns during a knitting process. In an aspect, the knitting machine 10 can include 16 yarn-feeders and corresponding rails, and thus can manipulate up to 16 different yarns during a knitting process. In an aspect, the knitting machine 10 can include 32 yarn-feeders and corresponding rails, and thus can manipulate up to 32 different yarns during a knitting process. In any of the aforementioned configurations, the yarns 13 supplied by the reels/spools 11 can be directed through a yarn-routing assembly 25 to corresponding yarn-feeders 20, as shown in FIGS. 1 and 2.

The knitting machine 10 has a lengthwise direction identified by element 24. The lengthwise direction 24 extends between ends 26, 28 of the knitting machine 10 as shown in FIG. 1. The needle beds 14, 16, the gap 15, and the plurality of rails 22 each extend along the lengthwise direction. During operation of the knitting machine 10, the plurality of yarn-feeders 20 also translate along the plurality of rails 22 in the lengthwise direction 24. The yarn-feeders 20 are shifted through operation of, and engagement with, the carriage 18. During a knitting process, the carriage 18 engages selected yarn-feeders 20 and performs a back-and-forth motion thereby shifting the selected yarn-feeders 20 so that those yarn-feeders 20 can deposit yarns 13 onto the needle beds 14, 16 of the knitting machine 10.

The needle beds 14, 16 extend in the lengthwise direction 24 and are angled relative to each other. The needle beds 14, 16 thus form a V-bed configuration in the depicted aspect. The gap 15 between the needle beds 14, 16 also extends along the lengthwise direction 24. The spacing distance of the gap 15 is measured between the distal end of each needle bed 14, 16. This spacing distance can differ based on the knitting machine (e.g., the gap 15 could be 1-5 millimeters in different aspects). In some knitting machines, this spacing distance can be adjusted, e.g., increased/decreased through mechanically adjusting the spacing between adjacent needle beds, e.g., to accommodate a particular knitting and/or inlay operation.

The needle bed 14 includes a plurality of needles 30 (only some identified in FIG. 2 for clarity purposes). The needles 30 extend at least partially toward the gap 15. The needle bed 16 includes a plurality of needles 32 (only some identified in FIG. 2 for clarity purposes). The needles 32 extend at least partially toward the gap 15. Each needle 30, 32 is adjustable into different positions/configurations. In particular, each needle has a first position that is a retracted position and a second position that is an extended position. In the first position, the needles 30, 32 are each spaced from an intersection of a first plane, defined by the needle bed 14, and a second plane, defined by the needle bed 16. In the second position, each needle 30, 32 passes through the intersection of the first plane and the second plane. This adjustability allows the needles 30, 32 to be adjusted in coordination with operation of the yarn-feeders 20 that deposit yarns on the needle beds 14, 16 to thereby form a knitted structure on the knitting machine 10.

Figure 4:
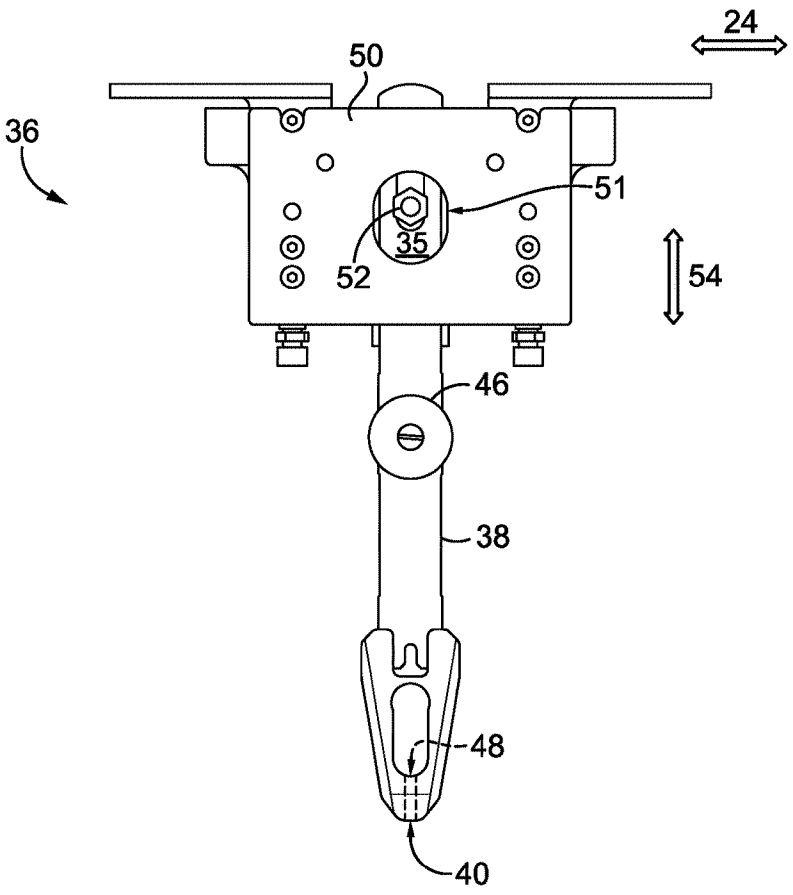
FIG. 4 depicts the yarn-feeder of FIG. 3 in assembled form, in accordance with aspects hereof.
Figure 3:
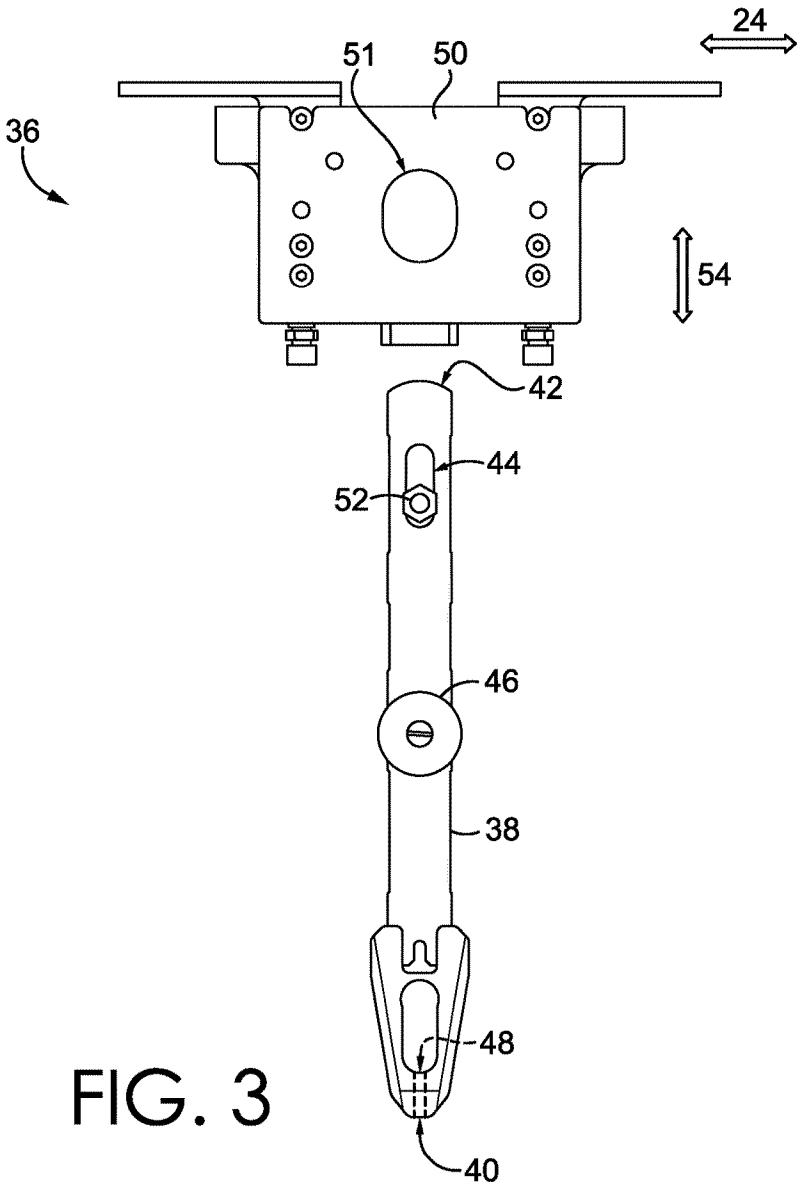
FIG. 3 depicts a yarn-feeder for a knitting machine in exploded form, in accordance with aspects hereof.

Looking now at FIG. 3, a yarn-feeder 36 is shown, in accordance with aspects hereof. In FIG. 3, the yarn-feeder 36 is shown in exploded form. FIG. 4 shows the components of the yarn-feeder 36 in assembled form, e.g., suitable for integration into the knitting machine 10. The yarn-feeder 36 can correspond to one or more of the plurality of yarn-feeders 20 identified in FIG. 1. The yarn-feeder 36 is intended to represent one of a number of possible configurations that can be used to guide, feed, and deposit yarns onto needle beds of a knitting machine, e.g., the knitting machine 10 shown in FIGS. 1 and 2, during a knitting operation.

The yarn-feeder 36 includes an elongated body 38. The elongated body 38 includes an end 40 and an end 42. The end 42, or a portion of the elongated body 38 adjacent thereto, is configured to couple to an attachment structure 50. The attachment structure 50 is configured so that it can attach to one of the plurality of rails 22 of the knitting machine 10 shown in FIG. 1. This allows the yarn-feeder 36 to then be shifted to different positions along the rail 22 by the carriage 18. The elongated body 38 includes a slot 44. The slot 44 is configured to receive and secure a fastener 52 (e.g., pin, bolt, screw, nut, combination thereof, or the like). The fastener 52 can be secured in the slot 44 through an opening 51 in the attachment structure 50 so that the fastener 52 movably constrains the elongated body 38 in the attachment structure 50. This forms a movable coupling 35 between the elongated body 38 and the attachment structure 50, as shown in FIG. 4. The movable coupling 35 allows the elongated body 38 to shift between a raised position and a lowered position, e.g., along a direction 54 that is substantially perpendicular to the lengthwise direction 24 that is the axis along which the yarn-feeder 36 translates when installed on the knitting machine 10.

Looking still at FIGS. 3 and 4, the elongated body 38 includes a thread-guiding wheel 46 and also includes an aperture 48 that extends through the end 40 of the elongated body 38. When the yarn-feeder 36 is assembled and attached to the knitting machine 10, a yarn 13 can be fed from a reel/spool 11, guided along the yarn-routing assembly 25, guided over the thread-guiding wheel 46, and then can be directed through the aperture 48 where it can then be deposited onto the needle beds 14, 16 to form part of a knitted structure formed on the needle beds 14, 16. FIG. 4 depicts the yarn-feeder 36 with its components assembled for attachment to the knitting machine 10. The yarn-feeder 36, once attached to a rail 22 of the knitting machine 10, can be coupled to or can include an actuator (e.g., a linear actuator, e.g., such as a piezo actuator). The actuator can be operable, e.g., at the direction of a control system of the knitting machine 10, to shift the elongated body 38 between a raised position and a lowered position along the direction 54 shown in FIG. 4.

Figure 6:
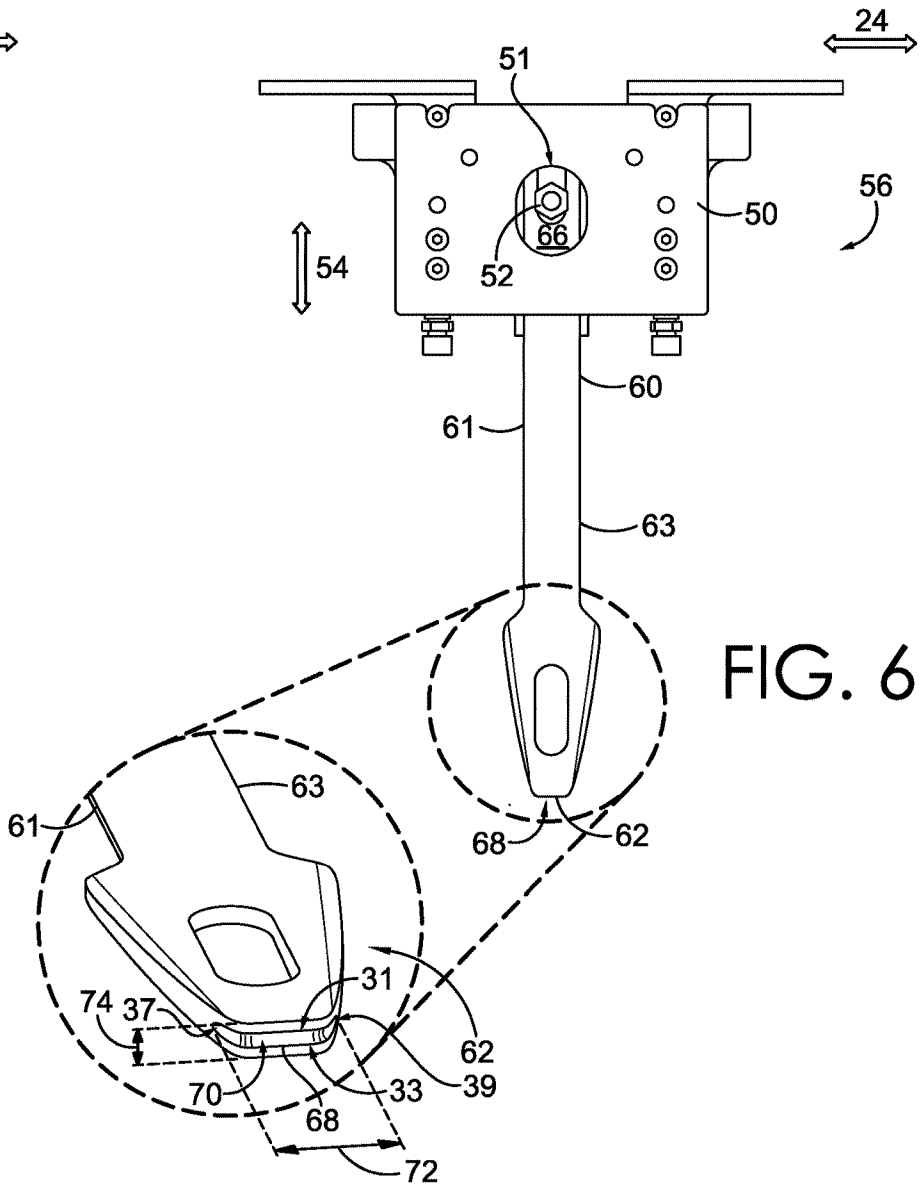
FIG. 6 depicts the stitch-pressing component of FIG. 5 in assembled form, in accordance with aspects hereof.
Figure 5:
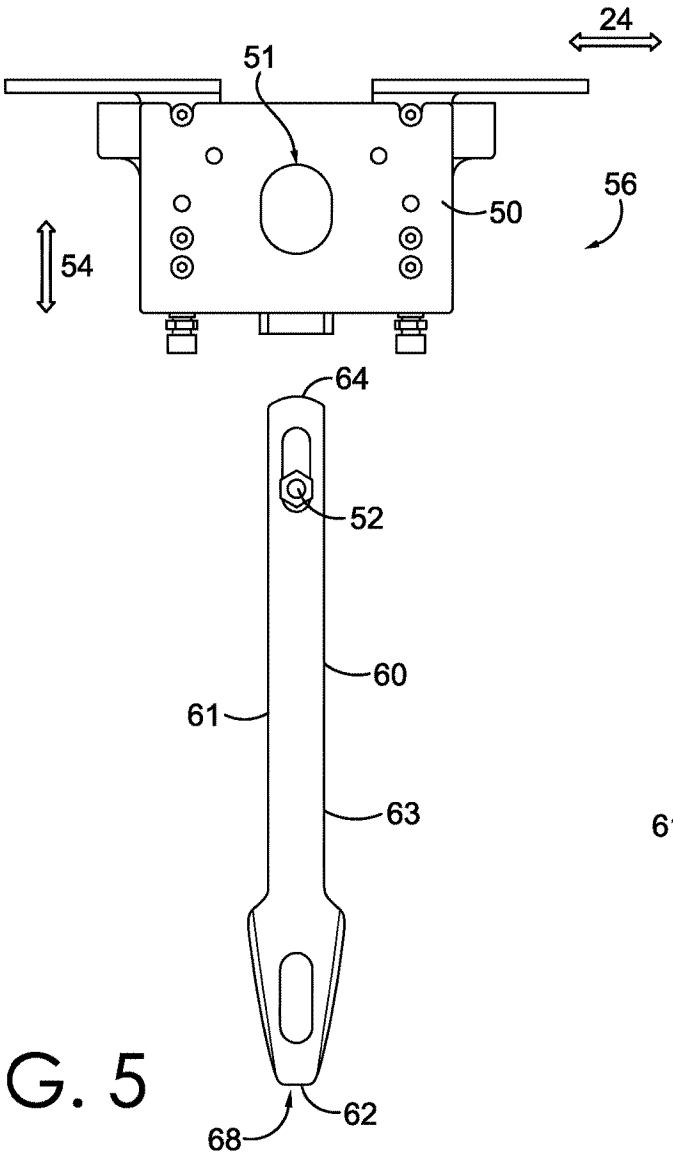
FIG. 5 depicts one configuration of a stitch-pressing component, in accordance with aspects hereof.

Looking now at FIG. 5, a stitch-pressing component 56 is shown, in accordance with aspects hereof. FIG. 5 shows the stitch-pressing component 56 in exploded form. FIG. 6 shows the stitch-pressing component 56 in assembled form, e.g., suitable for integration into a knitting machine, e.g., the knitting machine 10 shown in FIG. 1.

The stitch-pressing component 56 has a generally similar configuration as the yarn-feeder 36 shown in FIGS. 3 and 4. For example, the stitch-pressing component 56 includes the attachment structure 50 that is configured to attach to the knitting machine 10. However, the stitch-pressing component 56 includes an elongated body 60 that is different from the elongated body 38 shown in FIGS. 3 and 4. In particular, the elongated body 60 includes an end 62, an end 64, a side 61, and a side 63. The end 64, or a portion of the elongated body 60 adjacent, couples to the attachment structure 50. The fastener 52 is again secured through the attachment structure 50 and through the elongated body 60 to form a movable coupling 66 that allows the elongated body 60 to shift between a raised position and a lowered position, e.g., along the direction 54, similar to the yarn-feeder 36 shown in FIG. 4. The elongated body 60 does not include a yarn-guiding wheel or structure that is used for guiding yarns supplied by the reels/spools 11 of the knitting machine 10. Instead, the end 62 includes a pressing tip 68. The pressing tip 68 is shaped, oriented, and positioned such that it can be used to press against part of a knitted structure (e.g., an inlaid yarn such as a cable, strand, filament or another tensile element or reinforcing element) formed by the knitting machine 10 shown in FIG. 1. In particular, the pressing tip 68 is shaped, oriented, and positioned so that it can press in the direction 54 (e.g., by translating the elongated body 60 from the raised position to the lowered position) and then slide along the structure being pressed (e.g., by translating the attachment structure 50 along a rail 22 of the knitting machine 10) in the lengthwise direction 24.

The pressing tip 68 can be formed as a unified, solid, and/or fixed structure, e.g., as shown in connection with FIGS. 5 and 6. In other aspects, the pressing tip 68 can be formed to have a movable/adjustable configuration (e.g., such that parts of the pressing tip 68 can shift along the direction 24). To facilitate a pressing function, the pressing tip 68 includes an elongated-channel 70 shaped to engage part of a knitted structure (e.g., an inlaid yarn). The elongated-channel 70 has a long axis 72 and a short axis 74. The stitch-pressing component 56 is configured so that upon attachment to one of the rails 22 of the knitting machine 10, the long axis 72 extends substantially in parallel with the lengthwise direction 24 shown in FIG. 1 (and/or substantially in parallel with and/or along a gap extending between a pair of needle beds, e.g., the gap 15 shown in FIG. 1). In addition, upon attachment to the knitting machine 10, the elongated body 60 is shiftable (e.g., using an attached actuator) between at least a raised position and a lowered position along the direction 54 shown in FIG. 6.

In aspects, the stitch-pressing component 56, and others described herein, can be configured so that the elongated body 60 can be adjusted between a raised position, at least one intermediate position, and a lowered position (e.g., to accommodate different pressing operations, depths of engagement, and/or pressing distances). In aspects, the attachment structure 50 may include one or more stoppers positioned between an upper end and a lower end thereof, and the elongated body 60 may be shiftable between the raised position and one or more intermediate positions (partially lowered positions) using the one or more stoppers positioned along the direction 54, and also may be shiftable between a raised position and a fully lowered position, in aspects.

Figure 7:
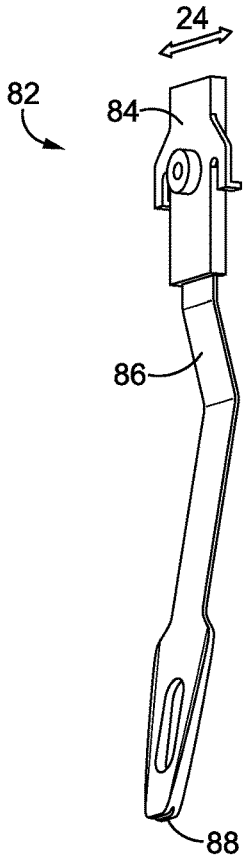
FIG. 7 depicts a different configuration for part of a stitch-pressing component, in accordance with aspects hereof.

In the aspect depicted in FIGS. 5 and 6, the elongated body 60 extends generally linearly without any significant tangential angularity from the lengthwise direction 24 (in contrast to the more tangentially angular component 82 shown in FIG. 7) and also tapers towards its end 62 where the pressing tip 68 is located. In other words, the elongated body 60 narrows, as measured between the sides 61, 63, as the elongated body 60 transitions towards the pressing tip 68 where the elongated-channel 70 is located. This configuration can be suitable when the pressing tip 68 will be used to impart pressure on a yarn but over a shorter length of the yarn (as measured along the long axis 72). In aspects, this can help limit interference with adjacent components of a knitting machine, e.g., that may perform functions near the pressing tip 68. In aspects, the elongated body 60 may be configured to have no taper, to have a reverse taper, and/or may be configured to be symmetrical along one or more axes when such geometries help accommodate a particular pressing operation.

In aspects, the pressing tip 68 and the elongated-channel 70 thereof can have different shapes, sizes, contours, and/or relative dimensions in accordance with what is suitable for a particular pressing operation. In aspects, the elongated-channel 70 can be shorter along the long axis 72 (e.g., to thereby provide a shorter-length pressing surface for pressing a yarn) or longer along the long axis 72 (e.g., to thereby provide a longer-length pressing surface for pressing a yarn) compared to what is shown in FIG. 6. In aspects, the elongated-channel 70 can be shorter along the short axis 74 (e.g., to thereby accommodate pressing a smaller-diameter yarn) or longer along the short axis 74 (e.g., to thereby accommodate pressing a larger-diameter yarn) compared to what is shown in FIG. 6. The channel width measured along the short axis 74 can be selected to provide some clearance on each side of the elongated-channel 70 when a yarn is inserted (e.g., at least 0.01-0.1 millimeters of clearance on each side). This clearance can help reduce friction and/or resistance, help ease insertion of a yarn into the elongated-channel 70, and/or help ease sliding of a yarn through the elongated-channel 70. The channel width measured along the short axis 74 can also be selected based on a needle bed gap. In aspects, the elongated-channel 70 can be 2-20 millimeters in length along the long axis 72 as measured between channel-end 37 and channel-end 39. In aspects, the elongated-channel 70 can be 0.1-4 millimeters in length along the short axis 74 as measured between channel-edge 31 and channel-edge 33. In aspects, the channel-edges 31, 33 can be aligned on the same plane that extends across the elongated-channel 70. In aspects, the channel-edges 31, 33 can extend substantially in parallel to each other. In aspects, the elongated-channel 70 can be anywhere from 0.1-3 millimeters deep within the pressing tip 68 (e.g., as measured perpendicular to a plane defined across the channel-edges 31, 33). In aspects, the depth of the elongated-channel 70 can remain the same across a length of the elongated-channel 70 or can vary across a length of the elongated-channel 70.

To help the pressing tip 68 and the elongated-channel 70 thereof smoothly engage, press, slide along, and then disengage a yarn of a knitted structure (e.g., including doing so in opposite directions on a knitting machine), the ends of the elongated-channel 70 may be curved, contoured, or sloped, and/or generally symmetrical, so that a surface of the elongated-channel 70 can more smoothly transition onto the side 61 at the channel-end 37 and onto the side 63 at the channel-end 39, e.g., as shown in FIGS. 5 and 6. In aspects, the radius of curvature of these end curves, contours, or slopes can be between 10-500% of a length of the elongated-channel 70 as measured along the long axis 72. To provide one example, if a length of the elongated-channel 70 is 5 millimeters measured along the long axis 72 between the channel-ends 37, 39, the radius of curvature at each end can be 0.5 millimeters to 25 millimeters.

Looking now at FIG. 7, another stitch-pressing component 82 is shown, in accordance with aspects hereof. The component 82 shown in FIG. 7 includes an elongated body 86, a base 84, and a pressing tip 88. The base 84 is configured to be coupled to an attachment structure, e.g., the attachment structure 50 shown in FIGS. 5 and 6 or another similar structure. The component 82 is formed so that upon attachment to a rail 22 of the knitting machine 10, the elongated body 86 extends generally perpendicular to the lengthwise direction 24 identified in FIG. 1. However, the elongated body 86 has a greater degree of angularity (e.g., in a direction tangential to the direction 24) along its length between the base 84 and the pressing tip 88. This configuration can be suitable if the stitch-pressing component 82 is going to be mounted on a rail 22 of the knitting machine 10 that is offset (positioned laterally outward) from the gap 15 instead of one located directly over the gap 15. To state it differently, the elongated body 86 allows the stitch-pressing component 82 to be mounted on a rail 22 of the knitting machine 10 that is displaced from the gap 15, e.g., to either side in a direction perpendicular to the lengthwise direction 24 identified in FIG. 1, while still allowing the pressing tip 88 to be positioned over the gap 15 and perform pressing functions therein. The angularity of the elongated body 86 can increase or decrease depending on the lateral distance of the selected rail 22 from the gap 15. Looking at the aspect of FIG. 7, it can be seen that a point where the elongated body 86 changes direction tangentially is closer to the base 84 than to the pressing tip 88. The point of transition is selected to help provide a desired angle of approach/engagement for the pressing tip 88 in a gap of a knitting machine.

Looking now at FIGS. 8A-8D, different configurations of a pressing tip are shown, in accordance with aspects hereof. The pressing tips shown in FIGS. 8A-8D can each form part of a stitch-pressing component integrated into a knitting machine, e.g., the knitting machine 10 shown in FIG. 1. The pressing tips shown in FIGS. 8A-8D can be used to push or press on part of a knitted structure formed by a knitting machine (e.g., an inlaid yarn such as a cable, strand, or cord used as a tensile element or reinforcing element).

Figure 8A:
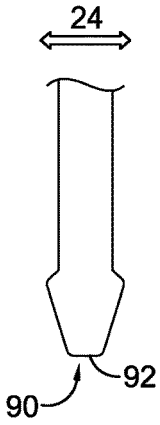
FIGS. 8A-8D depict different configurations of a pressing tip that forms part of a stitch-pressing component, in accordance with aspects hereof.

FIG. 8A depicts a pressing tip 90. The pressing tip 90 includes a distal end 92. The distal end 92 can include an elongated-channel having a short-axis and a long-axis (similar to the elongated-channel 70), the latter extending along the lengthwise direction 24. In the configuration depicted in FIG. 8A, the pressing tip 90 reduces in width (along the lengthwise direction 24) as it transitions to the distal end 92. This results in an elongated-channel that is shorter along the lengthwise direction. The pressing tip 90 shown in FIG. 8A is formed as a rigid structure without movable components, but can also be formed with movable components (e.g., that allow the pressing tip 90 to shift along the lengthwise direction 24) in aspects.

Figure 8B:
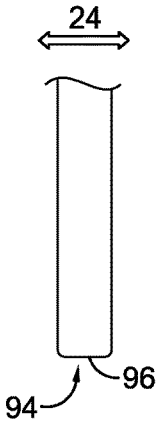

FIG. 8B depicts a pressing tip 94. The pressing tip 94 includes a distal end 96. The pressing tip 94 in FIG. 8B does not narrow or shorten along the lengthwise direction 24 as it transitions towards the distal end 96 like the pressing tip 90 shown in FIG. 8A. This results in a longer elongated-channel at the distal end 96. The pressing tip 94 has generally 90-degree transitions on opposite sides of the distal end 96. The pressing tip 94 shown in FIG. 8B is formed as a rigid structure without movable components, but can also be formed with movable components (e.g., that allow the pressing tip 94 to shift along the lengthwise direction 24) in aspects.

Figure 8C:
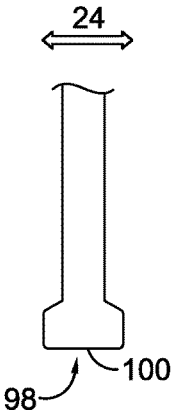

FIG. 8C depicts a pressing tip 98. The pressing tip 98 includes a distal end 100. The pressing tip 98 in FIG. 8C widens in the lengthwise direction 24 as it transitions towards the distal end 100. This results in an even longer elongated-channel at the distal end 100, e.g., which allows for pressing along a longer length of yarn compared to the pressing tips 90, 94. The pressing tip 98 shown in FIG. 8C is formed as a rigid structure without movable components, but can also be formed with movable components (e.g., that allow the pressing tip 98 to shift along the lengthwise direction 24) in aspects.

The pressing tips 90, 94, 98 shown in FIGS. 8A-8C provide a sequentially longer elongated-channel thereon to allow for pressing along a longer length of an inlaid yarn. These can each be suitable depending on the particular knitting process being performed. For example, factors such as speed of knitting, spacing of components on a knitting machine, size and spacing of elements in a knitted structure, and other factors can drive the selection of a pressing tip that allows for effective positioning of a component in a knitted structure in balance with the operational requirements of a knitting machine. The ability to implement stitch-pressing components with different pressing tips in place of yarn-feeders on a knitting machine means the process of modifying a knitting machine to accommodate different stitch-pressing/knitting operations is simpler, faster, and less complex. This helps increase adaptability and manufacturing efficiency, helps reduce cost, and helps increase the sustainability of related manufacturing processes, among other benefits.

Figure 8D:
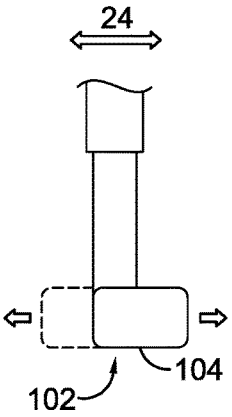

FIG. 8D depicts another pressing tip 102. The pressing tip 102 includes a distal end 104 that is adjustable (or shiftable) into different positions (e.g., as shown in FIG. 8D). This allows an elongated-channel formed in the distal end 104 to shift/translate back-and-forth along the lengthwise direction 24. This in turn helps the pressing tip 102 more smoothly shift along a length of a yarn. It can also help facilitate a smooth transition from pressing a yarn along one direction with the pressing tip 102 to pressing a yarn along an opposite second direction with the pressing tip 102. To state it differently, the shape of the elongated channel (e.g., open at both ends and generally symmetrical in contour) and the movable nature of the pressing tip 102 (e.g., shiftable in opposite directions) together can support bi-directional pressing with the pressing tip 102 during knitting operations. In the depicted aspect of FIG. 8D, the distal end 104 is slidably coupled at the pressing tip 102, e.g., through use of a slidable coupling such as a pin-and-slot, a sliding track, or another configuration that allows for linear translation of adjacent structures.

Figure 9A:
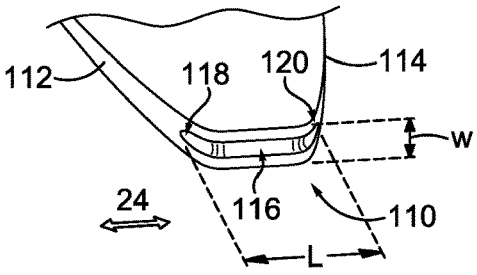
FIGS. 9A and 9B depict different configurations of a pressing tip of a stitch-pressing component, in accordance with aspects hereof.
Figure 9B:
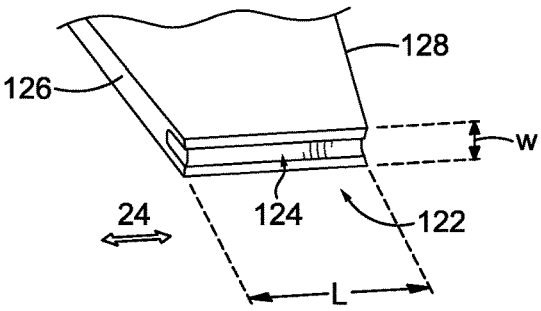

FIGS. 9A and 9B depict different configurations of an elongated channel that can be formed in a pressing tip of a stitch-pressing component, in accordance with aspects hereof. FIG. 9A shows a pressing tip 110. The pressing tip 110 extends between a side 112 and a side 114. The pressing tip 110 includes an elongated-channel 116 (e.g., indent, concavity, or groove) defined by a long axis (L) and a short axis (W) that is generally perpendicular to the long axis (L), as shown in FIG. 9A. When implemented in a knitting machine, the long axis (L) aligns with the lengthwise direction 24, as shown in FIG. 1, so that the elongated-channel 116 is able to slide along an inlaid component (e.g., a yarn including one formed as a strand, cable, or filament). The elongated-channel 116 includes a channel-end 118 that opens to the side 112 and a channel-end 120 that opens to the side 114. The channel-ends 118, 120 can be curved, contoured, or sloped such that each provides a substantially smooth transition toward and/or onto the sides 112, 114. This contouring of the elongated-channel 116 at its ends (and similarly on its sides) can help it engage and slide smoothly along a yarn including in opposite directions.

FIG. 9B shows another pressing tip 122 with an elongated-channel 124 formed therein. However, in FIG. 9B, the elongated-channel 124 extends such that the long-axis (L) of the elongated-channel 124 extends substantially the full length of the pressing tip 122 between the adjacent sides 126, 128. The long axis (L) again aligns with the lengthwise direction 24 as shown in FIG. 1. In additional aspects, the elongated channels can extend even further past the sides 126, 128 if the pressing tip is shaped to accommodate this extension.

Figure 10:
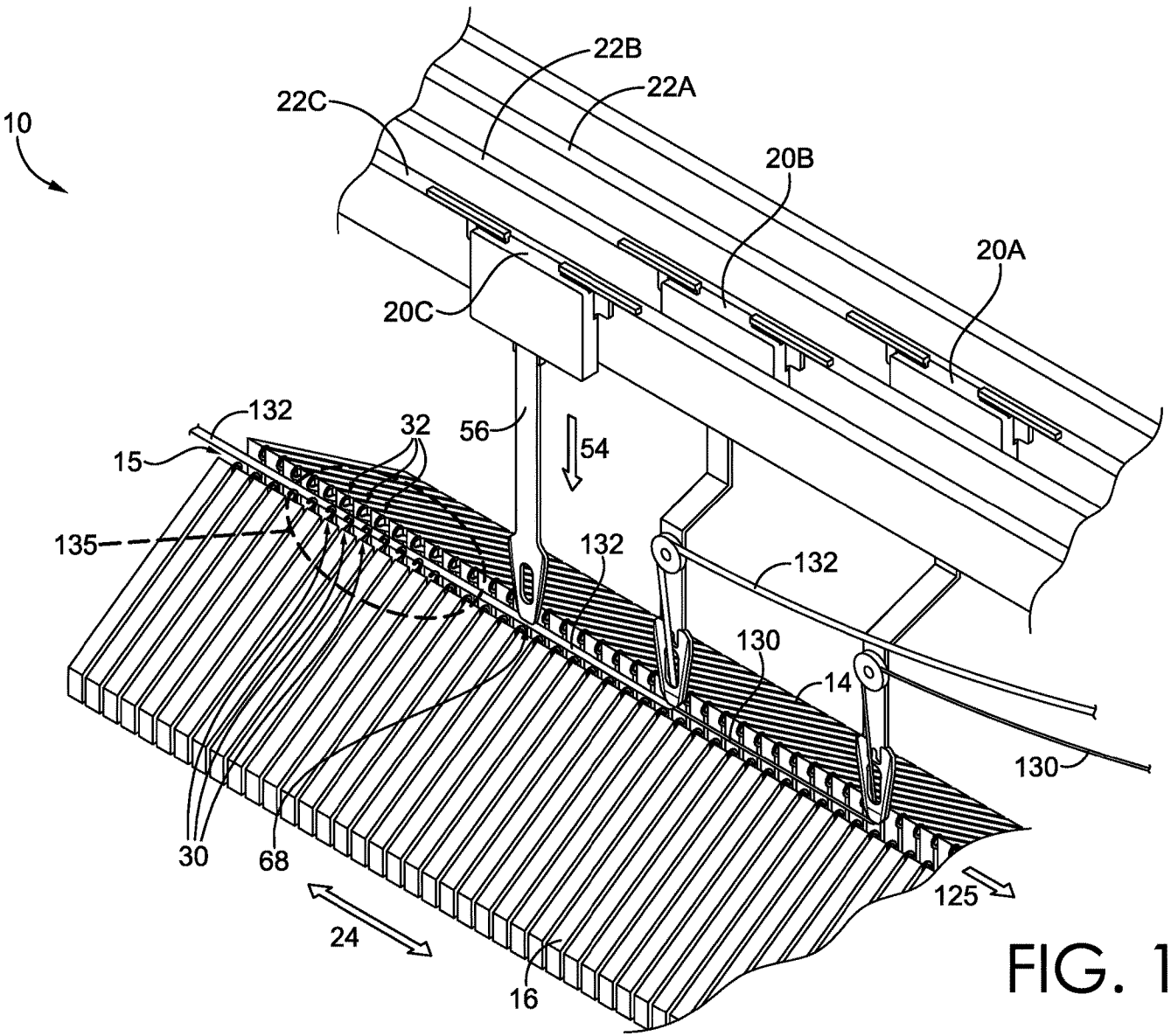
FIG. 10 depicts an example process of operating a knitting machine and performing stitch-pressing, in accordance with aspects hereof.

Looking now at FIG. 10, part of the knitting machine 10 from FIG. 1 is depicted, in accordance with an aspect hereof. FIG. 10 in particular shows the knitting machine 10 with the stitch-pressing component 56 of FIGS. 5 and 6 integrated thereon. The stitch-pressing component 56 is mounted in place of a yarn-feeder (e.g., on component 20C in FIG. 10) that otherwise could be used to deposit yarn onto the needle beds 14, 16. The stitch-pressing component 56 is mounted on component 20C to allow the stitch-pressing component 56 to be shifted along the needle beds 14, 16 and while doing so push, press, bias, or otherwise shift or maintain a positon of part of a knitted structure formed on the needle beds 14, 16 of the knitting machine 10.

FIG. 10 depicts rails 22A, 22B, 22C of the knitting machine 10 extending over the needle beds 14, 16 along the lengthwise direction 24. In FIG. 10, a number of other components of the knitting machine 10 are omitted for clarity/explanation purposes. FIG. 10 again shows how the needle beds 14, 16 are separated by the gap 15 that extends along the lengthwise direction 24 between the needle beds 14, 16. Yarn-feeder 20A is attached to rail 22A. The yarn-feeder 20A is able to translate along the rail 22A in the lengthwise direction 24, e.g., through operation of the carriage 18 (not shown in FIG. 10). This translation allows the yarn-feeder 20A to deposit a yarn 130 onto the needle beds 14, 16, e.g., in a knitting direction 125 as shown in FIG. 10. Yarn-feeder 20B is attached to rail 22B. The yarn-feeder 20B is able to translate along the rail 22B in the lengthwise direction 24. This allows the yarn-feeder 20B to deposit a yarn 132 along the gap 15 between the needle beds 14, 16, e.g., in the knitting direction 125 as shown in FIG. 10. The yarn-feeders 20A, 20B (as well as others not shown in FIG. 10) can be operated in coordination, e.g., to perform inlays together or in a coordinated sequence during a process of forming a knitted structure. In this example, the yarn-feeder 20A performs its inlay ahead of the yarn-feeder 20B (relative to the knitting direction 125). While one inlay process is shown in FIG. 10, numerous others are contemplated herein in connection with the stitch-pressing operation subsequently described herein.

In the process shown in FIG. 10, the yarn 132 is being inlaid into the gap 15 between the needle beds 14, 16 so that other parts of a knitted structure can be formed around the yarn 132, e.g., through manipulation of the yarn 130 and/or other yarns supplied by other yarn-feeders of the knitting machine 10 not shown in FIG. 10. During this yarn-inlaying process, knit stitches are formed on the needle beds 14, 16 through operation (e.g., shifting) of the needles 30, 32 on the needle beds 14, 16. The needles 30 are associated with the needle bed 14 (where only a portion of the needles 30 are identified for clarity purposes) and the needles 32 are associated with the needle bed 16 (where only a portion of the needles 32 are identified for clarity purposes). In the process depicted in FIG. 10, the yarn 132 is larger in diameter than the yarn 130. This differential in diameter can allow the yarn 132 to provide a complementary function in the knitted structure that is formed on the needle beds 14, 16. For example, this complementary function can include strength, reinforcement, stretch-containment, wear-resistance, structural definition, and the like. This complementary function can be provided by the material(s) forming the yarn 132 and/or by the properties (e.g., diameter, tensile strength, denier) of the yarn 132.

In some aspects, the yarn 132 can be a strand, cable, cord, filament, or monofilament formed of a stretch-resistant material (e.g., cotton, wool, hemp, or another material), and a remainder of the yarns used to form the knitted component can be yarns with higher elasticity and stretch-characteristics (e.g., polyester yarns, nylon yarns, spandex yarns, elastane yarns, or the like). The yarn 132 can also be a single-component yarn or a multi-component yarn (e.g., the latter can be provided by a yarn that is wound, woven, braided, joined, or otherwise formed as a multiple component yarn). In aspects, the yarn 132 can be 1.1-5 times larger in diameter than the yarn 130 as long as the gap 15 is large enough to accommodate insertion of the yarn 132. For example, in aspects, the yarn 132 can be at least 1 millimeter in diameter, at least 1.5 millimeters in diameter, at least 2 millimeters in diameter, at least 2.5 millimeters in diameter, or at least 3 millimeters in diameter, depending on the knitting process and desired construction of the knitted component. The yarn 130 can be at least 0.1 millimeters in diameter, at least 0.2 millimeters in diameter, at least 0.3 millimeters in diameter, at least 0.4 millimeters in diameter, or at least 0.5 millimeters in diameter, or another diameter that is less than a diameter of the yarn 132. In aspects, the diameter of the yarn 132 can be at least 0.5 millimeters, at least 1 millimeter, or at least 2 millimeters larger than the diameter of the yarn 130. The aforementioned examples are intended to be non-limiting.

In some aspects, the yarn 132 introduced along the gap 15 can be selected to function as a tensile element or reinforcing structure in the knitted component that is formed on the needle beds 14, 16 of the knitting machine 10. In aspects, the yarn 132 can be a high-tenacity yarn, e.g., one that is at least 5 grams per Denier (g/D). For example, a high-tenacity yarn such as a polyester yarn, e.g., a non-elasticated polyester yarn, can be used as the yarn 132. The tenacity of the yarn 132 can be selected so that it is higher than other yarn(s) of the knitted component formed on the knitting machine 10, e.g., the yarn 130. The stretch-resistance of the yarn 132 can be selected so that it is higher than other yarn(s) of the knitted component formed on the knitting machine 10, e.g., such as the yarn 130. To impart higher stretch-resistance, engineering filaments used in high tensile strength applications can be selected as the yarn 132. For example, glass, aramids (e.g., para-aramids or meta-aramids), high molecular weight polyethylene, ultra-high molecular weight polyethylene, and liquid crystal polymer can be used as the yarn 132 to impart such properties. The tenacity and/or tensile strength of a yarn can be determined under the same testing conditions and using the same test method such as one provided by the American Society of Testing and Materials ("ASTM"), e.g., ASTM D2256 or ASTM D3822.

In instances where the yarn 132 is larger in diameter than other yarns used to form a knitted structure on the needle beds 14, 16, as in the process depicted in FIG. 10, a needle gauge used in the needle beds 14, 16 may be selected to accommodate the smaller-diameter yarns that form the knitted structure around the yarn 132. The use of smaller gauge needles means that if those needles contact or impact the larger-diameter yarn 132 inlaid along the gap 15, the needles can be dislodged, degraded, and/or damaged. This can undesirably affect a knitting operation performed by the knitting machine 10. For example, in such instances, the needles can break, become bent, become jammed, or otherwise the knitting operation may be required to stop. This, however, can be limited through use of a stitch-pressing component (e.g., component 56 shown in FIG. 10) that is installed in place of a yarn-feeder.

FIG. 10 depicts the yarn-feeder 20A being shifted along the rail 22A in the knitting direction 125 that is also the lengthwise direction 24. This translation can be imparted by operation of the carriage 18, which is omitted from FIG. 10 for clarity but is shown in FIGS. 1 and 2. During this shifting of the yarn-feeder 20A, the yarn 130 is deposited onto the needle beds 14, 16 by the yarn-feeder 20A. FIG. 10 also shows the yarn-feeder 20B shifting along the rail 22B. In particular, the yarn-feeder 20B is traveling behind the yarn-feeder 20A. This translation can also be imparted by operation of the carriage 18, which is omitted from FIG. 10 for clarity but is shown in FIGS. 1 and 2. This translation also allows the yarn-feeder 20B to deposit the yarn 132 along the gap 15 between the needle beds 14, 16.

Looking still at the example process shown in FIG. 10, as the yarn-feeders 20A, 20B translate along the rails 22A, 22B and deposit their yarns 130, 132 onto the needle beds 14, 16, it can be seen how the needles 30, 32 of the needle beds 14, 16 are subsequently operated (e.g., adjusted into a closed position) in a controlled fashion so that a knitted structure can be formed on the needle beds 14, 16 and around the larger-diameter yarn 132 in the area 135 shown in FIG. 10. To limit the needles 30, 32 from contacting the larger-diameter yarn 132 positioned along the gap 15 (potentially resulting in the undesirable effects noted above), the stitch-pressing component 56 mounted on component 20C is shifted along the rail 22C behind the yarn-feeder 20B generally with the pressing tip 68 aligned with a path of the yarn 132 inlaid by the yarn feeder 20B. The stitch-pressing component 56 is also actuated so that the pressing tip 68 is in a lowered position that is closer to the gap 15. This alignment and lowering of the pressing tip 68 allows the pressing tip 68 to push or press the yarn 132 inlaid along the gap 15 by the yarn-feeder 20B towards or even into the gap 15 and away from an area of interaction of the needles 30, 32. The stitch-pressing component 56 can hold or maintain the yarn 132 in the gap 15 so that the needles 30, 32 of the needle beds 14, 16 can be operated to form the knitted structure over, around, and/or adjacent to the inlaid yarn 132. Through the knitting operation, the stitch-pressing component 56 can continue translating and pressing downward along a length of the yarn 132 as the knitted structure continues to be formed.

The yarn 132 shown in FIG. 10 generally includes a circular cross-sectional shape. However, in aspects, an inlaid yarn can include a non-circular cross-sectional shape (e.g., a square or rectangular cross-sectional shape). The pressing tip 68 can be selected to conform to this shape (e.g., having an opening and/or channel profile configured to receive and slide along such non-circular yarn shapes). In aspects, a stitch-pressing component, being adapted for this type of yarn, can be used to press the yarn into a gap (as described in connection with FIG. 10) and can also be used to maintain a desired axial orientation of the yarn in the knitted structure that is formed (e.g., by limiting axial rotation of the yarn during inlaying/formation of the knitted structure).

The use of a stitch-pressing component in the position of a yarn-feeder on a knitting machine provides additional advantages. For example, looking at FIG. 10, once a pressing operation is completed using the stitch-pressing component 56, the shape of the pressing tip 68 (e.g., which accommodates bi-directional pressing) in combination with the ability of the stitch-pressing component 56 to be shifted in opposite directions along the rail 22C means that a similar stitch-pressing operation can be performed but in the opposite direction on the knitting machine 10. In addition, in the example of FIG. 10, the rail 22C is a central rail (e.g., an inner most rail or one of two inner most rails). The selection of a central rail means that additional components of the knitting machine 10, e.g., yarn-feeders on other adjacent rails, can continue operating with limited interference to the operation of the stitch-pressing component 56. In addition, the stitch-pressing component 56 can also easily be interchanged with another stitch-pressing component, e.g., one having a larger, smaller, or differently configured pressing tip and/or elongated channel that is suitable for pressing a different yarn or knitted structure.

In an aspect, a knitting machine may include a plurality of yarn-feeders for introducing yarns onto a pair of needle beds separated by a gap, where a stitch-pressing component is positioned in place of one yarn-feeder. During a knitting operation, a first yarn-feeder may inlay a yarn into the gap along a first knitting direction while the stitch-pressing component pushes the yarn into the gap as a knitted structure is formed over the yarn in the first knitting direction. Then, the first yarn-feeder inlays the yarn into the gap along a second knitting direction that is opposite to the first knitting direction while the stitch-pressing component pushes the yarn into the gap as a knitted structure is formed over the yarn in the second knitting direction.

FIG. 10 is intended to illustrate one example stitch-pressing operation with one example knitting machine, yarn selection, stitch-pressing component, and component placement, and many other configurations, and similar stitch-pressing operations are contemplated herein.

Figure 11:
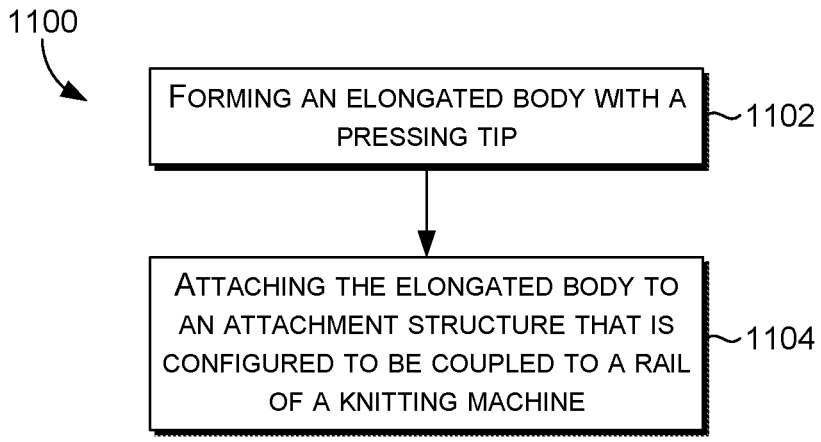
FIG. 11 depicts a block diagram of a method of forming/manufacturing a stitch-pressing component, in accordance with aspects hereof.

Looking now at FIG. 11, a block diagram of an example method 1100 of manufacturing a stitch-pressing component, e.g., the stitch-pressing component 56 shown in FIGS. 5 and 6, is provided, in accordance with aspects hereof. The method 1100 includes blocks 1102-1104 but is not limited to this selection of elements, or the order depicted. In block 1102, the method 1100 includes forming an elongated body, e.g., the elongated body 60 shown in FIGS. 5 and 6, with a pressing tip, e.g., the pressing tip 68 shown in FIGS. 5 and 6. In block 1104, the method 1100 includes attaching the elongated body to an attachment structure, e.g., the attachment structure 50 shown in FIGS. 5 and 6, that is configured to be coupled to a rail of a knitting machine, e.g., the rails 22 of the knitting machine 10 shown in FIG. 1.

Figure 12:
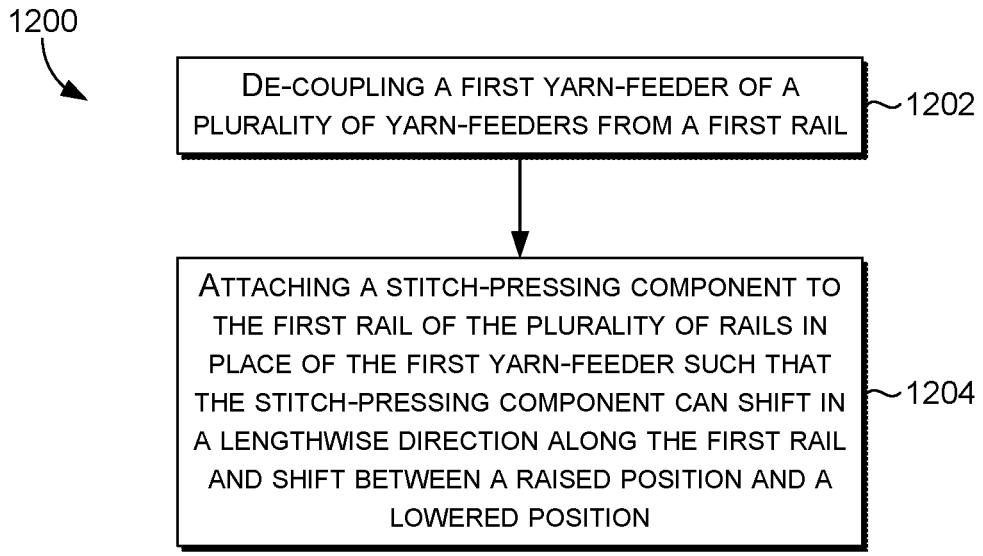
FIG. 12 depicts a block diagram of a method of integrating/using a stitch-pressing component with a knitting machine, in accordance with aspects hereof.

Looking now at FIG. 12, a block diagram of an example method 1200 of modifying a knitting machine, e.g., the knitting machine 10 of FIG. 1, for stitch-pressing is provided, in accordance with aspects herein. The method 1200 includes blocks 1202-1204 but is not limited to this selection of elements, or the order depicted. In block 1202, the method 1200 includes de-coupling a first yarn-feeder, e.g., one of the yarn-feeders 20 shown in FIG. 1, of a plurality of yarn-feeders from a first rail, e.g., one of the plurality of rails 22 shown in FIG. 1. In block 1204, the method 1200 includes attaching a stitch-pressing component, e.g., the stitch-pressing component 56 shown in FIGS. 5 and 6, to the first rail of the plurality of rails in place of the first yarn-feeder such that the stitch-pressing component can shift in a lengthwise direction, e.g., the direction 24 shown in FIG. 1, along the first rail, and shift between a raised position and a lowered position, e.g., along the direction 54 shown in FIGS. 5 and 6.

In an aspect, a yarn-feeder includes a first component (e.g., that feeds a yarn onto needle beds of a knitting machine) and a second component (e.g., that attaches to a rail of the knitting machine). The first component is configured to movably attach to the second component. In addition, a third component is configured to replace the first component. The third component includes an elongated body extending to a pressing tip with an elongated channel. The third component can include no yarn-guiding apertures, mechanisms, or features, but can be shifted similarly to the first component (e.g., between a raised position and a lowered position).

In an aspect, a method of modifying a knitting machine that includes a plurality of yarn-feeders, a plurality of rails, and at least one needle bed is provided. The method includes de-coupling a first component of a yarn-feeder from a second component of the yarn-feeder. The first component is configured to deposit yarn, and the second component is configured to slidably couple to a rail of the knitting machine. The method further includes coupling a stitch-pressing component to the second component in place of the first component.

In an aspect, a method of modifying a yarn-feeder is provided. The method includes de-coupling a first component of the yarn-feeder that includes one or more yarn-guiding features from a second component of the yarn-feeder that couples to a knitting machine. The method further includes modifying (e.g., through drilling, boring, welding, bonding, additive manufacturing, or other methods) the first component to have a pressing tip with an elongated channel. The method can in one non-limiting aspect further include removing one or more yarn-guiding features from the first component. The method further includes coupling the first component to the second component. The method further includes attaching the first component and the second component that are coupled together to the knitting machine and using the stitch-pressing component for pushing, pressing, biasing, or otherwise holding part of a knitted structure in position during a knitting process performed by the knitting machine.

In an aspect, a method of programming a knitting machine that controls operation of a carriage, a plurality of yarn-feeders, and one or more needle beds with adjustable needles is provided. The method includes modifying a control system of the knitting machine, e.g., through providing instructions, logic, and/or command inputs through a user-interface, so that the carriage changes from shifting a yarn-feeder to deposit yarns to shifting a stitch-pressing component that replaces the yarn-feeder to perform a stitch-pressing operation. The method further includes programming the knitting machine to shift another yarn-feeder to deposit a yarn while also shifting the stitch-pressing component to press on the yarn that is supplied by the another yarn-feeder.

In an aspect, a method of knitting using a knitting machine comprises inlaying a yarn into a gap between a pair of needle beds of the knitting machine using a first yarn-feeder; and, pressing the yarn into the gap using a stitch-pressing component coupled to a rail of the knitting machine in place of a second yarn-feeder. The method further comprises performing the pressing of the yarn in a first knitting direction on the knitting machine and in a second knitting direction on the knitting machine.

Clause 1. A stitch-pressing component for a knitting machine having a plurality of rails, a plurality of yarn-feeders, and a pair of needle beds, the stitch-pressing a component comprising an elongated body, comprising: a first side; a second side that is opposite to the first side; a first end, comprising: an attachment structure for coupling the stitch-pressing component to one of the plurality of rails in place of one of the plurality of yarn-feeders so that the stitch-pressing component can shift along the rail in a lengthwise direction and also shift between a raised position and a lowered position; and a second end, comprising: a pressing tip comprising an elongated channel with a long axis and a short axis, wherein the elongated channel is oriented such that the long axis extends in the lengthwise direction when the stitch-pressing component is coupled to one of the plurality of rails of the knitting machine.

Clause 2. The stitch-pressing component of clause 1, wherein the elongated channel comprises a first channel-end and a second channel-end that are oriented along the long axis, wherein the first channel-end comprises a first opening to the first side of the elongated body, and wherein the second channel-end comprises a second opening to the second side of the elongated body.

Clause 3. The stitch-pressing component of clause 1 or 2, wherein the first opening curves onto the first side of the elongated body towards the first end, and wherein the second opening curves onto the second side of the elongated body towards the first end.

Clause 4. The stitch-pressing component of any of clauses 1-3, wherein the pressing tip comprises a fixed structure at the second end of the elongated body.

Clause 5. The stitch-pressing component of any of clauses 1-4, wherein the pressing tip comprises a movable structure at the second end of the elongated body, and wherein the movable structure allows the pressing tip to shift along the long axis.

Clause 6. The stitch-pressing component of any of clauses 1-5, wherein the elongated channel comprises a first channel-edge and a second channel-edge that extend substantially parallel to each other along the long axis, and wherein the first channel-edge and the second channel-edge are spaced apart 1-3 millimeters along the short axis.

Clause 7. The stitch-pressing component of any of clauses 1-6, wherein the elongated body couples to the attachment structure such that the elongated body can shift between a raised position and a lowered position.

Clause 8. A method of operating a knitting machine, the knitting machine comprising a pair of needle beds, a plurality of rails extending over the pair of needle beds in a lengthwise direction, and a plurality of yarn-feeders, the method comprising de-coupling a first yarn-feeder of the plurality of yarn-feeders from a first rail of the plurality of rails; and attaching a stitch-pressing component to the first rail in place of the first yarn-feeder, such that the stitch-pressing component is configured to shift in the lengthwise direction along the first rail and shift between a raised position and a lowered position on the first rail, wherein the stitch-pressing component comprises: a first end, comprising: an attachment structure for coupling the stitch-pressing component to the first rail, and a second end, comprising: a pressing tip comprising an elongated channel with a long axis and a short axis, wherein the elongated channel is oriented such that the long axis extends in the lengthwise direction when the stitch-pressing component is coupled to the first rail. The elongated channel can include a long axis aligned with a direction of a gap between the pair of needle beds.

Clause 9. The method of clause 8, further comprising shifting a second yarn-feeder of the plurality of yarn-feeders along a second rail of the plurality of rails while the second yarn-feeder deposits a yarn into a gap between the pair of needle beds.

Clause 10. The method of clause 8 or 9, further comprising shifting the stitch-pressing component from the raised position to the lowered position so that the pressing tip pushes the yarn into the gap between the pair of needle beds.

Clause 11. The method of any of clauses 8-10, further comprising shifting, while the stitch-pressing component is in the lowered position, and while the pressing tip is pushing the yarn into the gap, the stitch-pressing component along the first rail to shift the pressing tip along a length of the yarn.

Clause 12. The method of any of clauses 8-11, further comprising shifting additional yarn-feeders of the plurality of yarn-feeders along corresponding rails of the plurality of rails while the additional yarn-feeders deposit corresponding yarns onto the pair of needle beds.

Clause 13. The method of any of clauses 8-12, further comprising: actuating, while the additional yarn-feeders are depositing their corresponding yarns onto the pair of needle beds, a plurality of needles on the pair of needle beds to thereby form a knitted structure over the yarn pressed into the gap by the stitch-pressing component.

Clause 14. The method of any of clauses 8-13, wherein the yarn is pushed into the gap by the pressing tip of the stitch-pressing component such that the plurality of needles can each shift into a closed position without contacting the yarn.

Clause 15. The method of any of clauses 8-14, wherein the yarn deposited by the second yarn-feeder is at least 1 millimeter larger in diameter than each yarn deposited by the additional yarn-feeders.

Clause 16. The method of any of clauses 8-15, wherein the first rail comprises a central rail of the plurality of rails, and wherein the additional yarn-feeders are positioned on rails laterally outward from the first rail.

Clause 17. The method of any of clauses 8-16, wherein the stitch-pressing component pushes the yarn into the gap without depositing any yarns that are used to form the knitted structure.

Clause 18. The method of any of clauses 8-17, further comprising: shifting a second yarn-feeder of the plurality of yarn-feeders in a first direction along a second rail of the plurality of rails while the second yarn-feeder deposits a yarn into a gap between the pair of needle beds; shifting the stitch-pressing component along the first rail in the first direction while the stitch-pressing component pushes the yarn from the second-yarn-feeder into the gap; shifting the second yarn-feeder along the second rail in a second direction that is opposite to the first direction while the second yarn-feeder deposits the yarn into the gap; and shifting the stitch-pressing component along the first rail in the second direction while the stitch-pressing component pushes the yarn from the second yarn-feeder into the gap.

Clause 19. A knitting machine, comprising a pair of needle beds separated by a gap; a plurality of rails extending over the pair of needle beds in a lengthwise direction; a plurality of yarn-feeders, each yarn-feeder attachable to one of the plurality of rails such that the yarn-feeder is shiftable along the rail in the lengthwise direction; and a stitch-pressing component, comprising: a first end comprising an attachment structure that couples the stitch-pressing component to one of the plurality of rails in place of one of the plurality of yarn-feeders, and a second end comprising a pressing tip with an elongated channel having a long axis and a short axis, wherein the elongated channel is oriented so that the long axis extends in the lengthwise direction when the stitch-pressing component is coupled to one of the plurality of rails of the knitting machine.

Clause 20. The knitting machine of clause 19, further comprising a first rail of the plurality of rails; and a second rail of the plurality of rails, wherein a first yarn-feeder of the plurality of yarn-feeders is coupled to the first rail such that the first yarn-feeder can shift along the first rail while depositing a yarn along the gap, and wherein the stitch-pressing component is coupled to the second rail such that the stitch-pressing component can shift along the second rail in a lowered position while the pressing tip pushes the yarn deposited by the first yarn-feeder into the gap.

Clause 21. The knitting machine of clause 19 or 20, wherein the first yarn-feeder and the stitch-pressing component are shiftable in unison, and such that a linear path of the pressing tip and a linear path of a distal end of the first yarn-feeder are aligned with a linear path of the gap between the pair of needle beds.

Clause 22. A method of manufacturing a stitch-pressing component or portion thereof according to any aspect herein.

Clause 23. A method of integrating into a knitting machine a stitch-pressing component or portion thereof according to any aspect herein.

Clause 24. A method of retrofitting a knitting machine for stitch-pressing according to any aspect herein.

Clause 25. The preceding clauses 1-24 and any elements thereof in any combination.

In some aspects, this disclosure may include the language, for example, "at least one of [element A] and [element B]." This language may refer to one or more of the elements. For example, "at least one of A and B" may refer to "A," "B," or "A and B." In other words, "at least one of A and B" may refer to "at least one of A and at least one of B," or "at least either of A or B." In some aspects, this disclosure may include the language, for example, "[element A], [element B], and/or [element C]." This language may refer to either of the elements or any combination thereof. In other words, "A, B, and/or C" may refer to "A," "B," "C," "A and B," "A and C," "B and C," or "A, B, and C." In addition, this disclosure may use the term "and/or" which may refer to any one or combination of the associated elements. In addition, this disclosure may use the term "a" (element) or "the" (element). This language may refer to the referenced element in the singular or in the plural and is not intended to be limiting in this respect.

The subject matter of this disclosure has been described in relation to particular aspects, which are intended in all respects to be illustrative rather than restrictive. In this sense, alternative aspects will become apparent to those of ordinary skill in the art to which the present subject matter pertains without departing from the scope hereof. In addition, different combinations and sub-combinations of elements disclosed, as well as use and inclusion of elements not shown, are possible and contemplated as well.

What is claimed is:

1. A stitch-pressing component for a knitting machine having a plurality of rails, a plurality of yarn-feeders, and a pair of needle beds, the stitch-pressing component comprising:

an elongated body, comprising:

a first side;

a second side that is opposite to the first side;

a first end, comprising:

an attachment structure for coupling the stitch-pressing component to one of the plurality of rails in place of one of the plurality of yarn-feeders so that the stitch-pressing component can shift along the rail in a lengthwise direction; and a second end, comprising:

a pressing tip comprising an elongated channel with a long axis and a short axis, wherein the elongated channel is oriented such that the long axis extends in the lengthwise direction when the stitch-pressing component is coupled to one of the plurality of rails of the knitting machine, wherein the pressing tip is a solid structure without an opening for feeding yarn axially through the pressing tip, and wherein the stitch-pressing component is adapted for pressing a yarn without depositing any yarns.

2. The stitch-pressing component of claim 1, wherein the elongated channel comprises a first channel-end and a second channel-end that are oriented along the long axis, wherein the first channel-end comprises a first opening to the first side of the elongated body, and wherein the second channel-end comprises a second opening to the second side of the elongated body.

3. The stitch-pressing component of claim 2, wherein the first opening curves onto the first side of the elongated body towards the first end, and wherein the second opening curves onto the second side of the elongated body towards the first end.

4. The stitch-pressing component of claim 1, wherein the pressing tip comprises a fixed structure at the second end of the elongated body.

5. The stitch-pressing component of claim 1, wherein the pressing tip comprises a movable structure at the second end of the elongated body, and wherein the movable structure allows the pressing tip to shift along the long axis.

6. The stitch-pressing component of claim 1, wherein the elongated channel comprises a first channel-edge and a second channel-edge that extend substantially parallel to each other along the long axis, and wherein the first channel-edge and the second channel-edge are spaced apart 1-3 millimeters along the short axis.

7. The stitch-pressing component of claim 1, wherein the elongated body couples to the attachment structure such that the elongated body can shift between a raised position and a lowered position.

8. A method of operating a knitting machine, the knitting machine comprising a pair of needle beds, a plurality of rails extending over the pair of needle beds in a lengthwise direction, and a plurality of yarn-feeders, the method comprising:

de-coupling a first yarn-feeder of the plurality of yarn-feeders from a first rail of the plurality of rails;

attaching a stitch-pressing component to the first rail in place of the first yarn-feeder, such that the stitch-pressing component is configured to shift in the lengthwise direction along the first rail and shift between a raised position and a lowered position on the first rail;

wherein the stitch-pressing component comprises:

a first end, comprising:

an attachment structure for coupling the stitch-pressing component to the first rail, and a second end, comprising:

a pressing tip comprising an elongated channel with a long axis and a short axis, wherein the elongated channel is oriented such that the long axis extends in the lengthwise direction when the stitch-pressing component is coupled to the first rail; and using the stitch-pressing component to press a yarn into a gap between the pair of needle beds without using the stitch-pressing component to deposit any yarns onto the pair of needle beds.

9. The method of claim 8, further comprising:

shifting a second yarn-feeder of the plurality of yarn-feeders along a second rail of the plurality of rails while the second yarn-feeder deposits a yarn into a gap between the pair of needle beds.

10. The method of claim 9, further comprising:

shifting the stitch-pressing component from the raised position to the lowered position so that the pressing tip pushes the yarn into the gap between the pair of needle beds.

11. The method of claim 10, further comprising:

shifting, while the stitch-pressing component is in the lowered position, and while the pressing tip is pushing the yarn into the gap, the stitch-pressing component along the first rail to shift the pressing tip along a length of the yarn.

12. The method of claim 11, further comprising:

shifting additional yarn-feeders of the plurality of yarn-feeders along corresponding rails of the plurality of rails while the additional yarn-feeders deposit corresponding yarns onto the pair of needle beds.

13. The method of claim 12, further comprising:

actuating, while the additional yarn-feeders are depositing their corresponding yarns onto the pair of needle beds, a plurality of needles on the pair of needle beds to thereby form a knitted structure over the yarn pressed into the gap by the stitch-pressing component.

14. The method of claim 13, wherein the yarn is pushed into the gap by the pressing tip of the stitch-pressing component such that the plurality of needles can each shift into a closed position without contacting the yarn.

15. The method of claim 13, wherein the yarn deposited by the second yarn-feeder is at least 1 millimeter larger in diameter than each yarn deposited by the additional yarn-feeders.

16. The method of claim 13, wherein the first rail comprises a central rail of the plurality of rails, and wherein the additional yarn-feeders are positioned on rails laterally outward from the first rail.

17. The method of claim 13, wherein the pressing tip is a solid tip without any apertures.

18. The method of claim 8, wherein the stitch-pressing component is attached to the first rail such that the pressing tip can translate along a length of the gap in the raised position and in the lowered position.

19. The method of claim 8, further comprising:

shifting a second yarn-feeder of the plurality of yarn-feeders in a first direction along a second rail of the plurality of rails while the second yarn-feeder deposits a yarn into a gap between the pair of needle beds;

shifting the stitch-pressing component along the first rail in the first direction while the stitch-pressing component pushes the yarn from the second yarn-feeder into the gap;

shifting the second yarn-feeder along the second rail in a second direction that is opposite to the first direction while the second yarn-feeder deposits the yarn into the gap; and shifting the stitch-pressing component along the first rail in the second direction while the stitch-pressing component pushes the yarn from the second yarn-feeder into the gap.

20. A knitting machine, comprising:

a pair of needle beds separated by a gap;

a plurality of rails extending over the pair of needle beds in a lengthwise direction;

a plurality of yarn-feeders, each yarn-feeder attachable to one of the plurality of rails such that the yarn-feeder is shiftable along the rail in the lengthwise direction; and a stitch-pressing component adapted for pressing a yarn into the gap without depositing any yarns, the stitch-pressing component comprising:

a first end comprising an attachment structure that couples the stitch-pressing component to one of the plurality of rails in place of one of the plurality of yarn-feeders, and a second end comprising a pressing tip with an elongated channel having a long axis and a short axis, wherein the elongated channel is oriented so that the long axis extends in the lengthwise direction when the stitch-pressing component is coupled to one of the plurality of rails of the knitting machine, wherein the pressing tip is a solid structure without an opening for feeding yarn axially through the pressing tip.

21. The knitting machine of claim 20, further comprising:

a first rail of the plurality of rails; and a second rail of the plurality of rails;

wherein a first yarn-feeder of the plurality of yarn-feeders is coupled to the first rail such that the first yarn-feeder can shift along the first rail while depositing a yarn along the gap, and wherein the stitch-pressing component is coupled to the second rail such that the stitch-pressing component can shift along the second rail in a lowered position while the pressing tip pushes the yarn deposited by the first yarn-feeder into the gap.

22. The knitting machine of claim 21, wherein the first yarn-feeder and the stitch-pressing component are shiftable in unison, and such that a linear path of the pressing tip and a linear path of a distal end of the first yarn-feeder are aligned with a linear path of the gap between the pair of needle beds.

* * * * *